US008177447B2

(12) United States Patent
Yoon

(10) Patent No.: US 8,177,447 B2
(45) Date of Patent: May 15, 2012

(54) SLIDE TYPE WRITING TOOLS HAVING DEVICE FOR PREVENT DRYNESS

(75) Inventor: Hyun-son Yoon, Seoul (KR)

(73) Assignee: Morris Corporation, Incheon-shi (KR)

( * ) Notice: Subject to any disclaimer, the term of this patent is extended or adjusted under 35 U.S.C. 154(b) by 643 days.

(21) Appl. No.: 12/299,119

(22) PCT Filed: Apr. 26, 2007

(86) PCT No.: PCT/KR2007/002056
§ 371 (c)(1),
(2), (4) Date: Dec. 3, 2008

(87) PCT Pub. No.: WO2007/126253
PCT Pub. Date: Nov. 8, 2007

(65) Prior Publication Data

US 2009/0136284 A1 May 28, 2009

(30) Foreign Application Priority Data

Apr. 28, 2006 (KR) ..... 10-2006-0038608

(51) Int. Cl.
*B43K 7/12* (2006.01)

(52) U.S. Cl. ..... 401/108; 401/107

(58) Field of Classification Search ..... 401/107, 401/108, 99
See application file for complete search history.

(56) References Cited

U.S. PATENT DOCUMENTS

| | | | | |
|---|---|---|---|---|
| 2,362,948 | A * | 11/1944 | Teague et al. | 401/106 |
| 3,583,820 | A * | 6/1971 | Koeln | 401/107 |
| 6,371,129 | B1 * | 4/2002 | Le Bras-Brown et al. | 132/218 |
| 7,220,073 | B2 * | 5/2007 | Yoon | 401/108 |
| 7,931,416 | B2 * | 4/2011 | Yoon | 401/108 |
| 2005/0191112 | A1 * | 9/2005 | Yoon | 401/108 |

* cited by examiner

*Primary Examiner* — Christopher Kim
(74) *Attorney, Agent, or Firm* — Intellectual Property Law Group LLP

(57) ABSTRACT

Disclosed herein is a slide type writing tool having a dryness prevention unit. The writing tool includes a hollow shaft (10) having a nib hole, with shutter shaft seats protruding from the inner wall of the shaft. A cartridge (20) is secured to the shaft. A knock part is inserted into an insert hole formed in the shaft, and a pair of pressing parts is provided on a nib extension shaft of the cartridge. A rear O-ring (30) surrounds an end of the cartridge. A spherical shutter (40) is held in the rear O-ring (30), and has a spherical shutter part to isolate a nib from the exterior. A front O-ring (50) contacts the shutter part and the nib hole. A spring contacts at a first end thereof a lower end of a step of the cartridge, and at a second end thereof a step of the rear O-ring.

4 Claims, 12 Drawing Sheets

SLIDE TYPE WRITING TOOLS HAVING DEVICE FOR PREVENT DRYNESS

TECHNICAL FIELD

The present invention relates, in general, to writing tools and, more particularly, to a slide type writing tool having a dryness prevention unit, which is constructed so that a nib which dispenses ink supplied from a cartridge is projected out only when the writing tool is in use, and the nib is retracted into the writing tool to be sealed therein when the writing tool is not in use.

BACKGROUND ART

Generally, writing tools are typically classified into fixed type writing tools, rotary type writing tools, knock type writing tools, and slide type writing tools. The fixed type writing tools are designed so that a cartridge is fixed and a cap is used to cover a nib. The rotary type writing tools are designed so that part of a cartridge moves along a spiral pipe to be projected out when part of a shaft is rotated. The knock type writing tools are designed so that a cartridge is projected out by a spring when part of a shaft is pressed. Further, the slide type writing tools are designed so that a cartridge slides to be retracted into and projected out of a shaft.

The slide type writing tools have an advantage in that it is unnecessary to open or close an additional cap. However, the slide type writing tools have a problem in that a nib hole is formed in an end of the writing tool, so that such a slide type structure may be limitedly applied only to non-volatile writing tools, such as oil-based ink, or to writing tools having low volatility.

Thus, writing tools having high volatility, for example, a marker pen, a correction pen, a roller ball pen, a highlighter, etc., must have caps, although it is inconvenient to open or close the caps. The reason why the writing tools having high volatility have the caps is that the ink of the nibs dries up when the nibs of the writing tools are exposed to the air, thus shortening the life spans of the writing tools.

In order to solve the problems, efforts have been made to develop a writing tool that prevents the ink of the writing tool, which is a liquid or a semi-liquid ink, or a volatile or non-volatile ink, from drying up, while protecting a nib of the writing tool.

In order to prevent a nib from drying up and protect the nib, Japanese Patent No. 1987-0012570 was proposed, and is entitled 'capless writing tool having dryness prevention unit'. The writing tool disclosed in the document has a slide type structure. When a user presses a push-button of the writing tool once, a cover is opened so that a nib hole is opened by the tensile force of an elastic cord. Further, when the user presses the push-button one more time, the cover is closed, thus preventing ink from drying up.

However, the writing tool according to the cited document has problems in that it uses the tensile force of the elastic cord, so that the opening or closing of the cover is not rapidly executed, and it has low durability, and further, the ability of the cover to temporarily close and seal the nib hole is very poor.

In Korean Patent Appln. No. 10-2000-65693 there was proposed a 'writing tool with inseparable elastic cap'. According to the cited document, the writing tool is provided with an elastic cap. The elastic cap has, at a predetermined position thereof, a cut slit through which a nib passes. Further, a predetermined portion of the elastic cap, which is opposite the cut slit, is in close contact with a guide groove of the writing tool. Thus, when the cap moves backward, the nib is exposed outside so that a user can write with the instrument. Conversely, when the cap moves forward, the cap prevents the ink from drying. The middle portion of the writing tool has the same shape as the body of a typical writing tool.

However, the writing tool according to Korean Patent Appln. No. 10-2000-65693 has a problem in that the portion around the cut slit may be stained with the ink of the nib, as the nib is exposed outside through the cut slit. Further, since the cut slit is closed by a subsidiary unit, such as a rubber ring, which is readily elastically deformed, the nib is in direct contact with the cut slit and is thereby broken or damaged, and the durability of the writing tool is relatively low. The writing tool is problematic in that the rubber ring is exposed outside the cut slit, so that the rubber ring may be damaged when the rubber ring comes into contact with an external object. Further, the cut slit may become deformed after frequent use of the writing tool, and thus the efficiency with which the nib is sealed may be deteriorated.

DISCLOSURE

Technical Problem

Accordingly, the present invention has been made keeping in mind the above problems occurring in the prior art, and an object of the present invention is to provide a slide type writing tool having a dryness prevention unit which is rapidly opened or closed in a direct transmission manner and is convenient to use, thus allowing the end of a cartridge, that is, the nib, to be extended and exposed outside through a non-contact extension operation, while the area around the nib remains sealed. Further, the slide type writing tool having the dryness prevention unit prevents the ink of the nib from drying up without requiring the use of a cap, and safely protects the nib.

Another object of the present invention is to provide a slide type writing tool having a dryness prevention unit, in which front and rear O-rings having a sealing function are made of special rubber, thus minimizing the volatilization of ink of a nib.

Technical Solution

In order to accomplish the objects, the present invention provides a slide type writing tool having a dryness prevention unit, including a hollow shaft 10 having at a first end thereof a nib hole 13, with a shutter shaft seat 12 protruding from an inner wall of the shaft; a cartridge 20 secured to an interior of the shaft 10 to correspond to a center of the nib hole 13, and including a knock part 29 inserted into an insert hole 14 formed in a second end of the shaft 10, and a pair of pressing parts 22 provided on an end of a nib extension shaft of the cartridge; a rear O-ring 30 surrounding an end of the cartridge 20; a spherical shutter 40 having a shape of a hollow sphere, held in the rear O-ring 30, and having a spherical shutter part 43 to isolate a nib 24 from an exterior; a front O-ring 50 contacting the shutter part 43, and coming into close contact with the nib hole 13; and a spring 7 contacting at a first end thereof a lower end of a step of the cartridge 20, and contacting at a second end thereof a step of the rear O-ring 30, thus axially biasing either the rear O-ring 30 or the cartridge 20 within a stroke distance of the cartridge 20, whereby the spherical shutter 40 is rotated by the pressing parts 22, so that the shutter part 43 opens the front O-ring 50, and thus the nib 24 is projected from the nib hole 13.

Advantageous Effects

As described above, a slide type writing tool having a dryness prevention unit according to the present invention has advantages in that it can be used without opening or closing an additional cap, and a nib hole can be opened or closed by the extension or retraction of a nib, thus preventing ink from drying up.

Further, the slide type writing tool having the dryness prevention unit according to the present invention has an integrated control module, so that the assembly of the writing tool is simple, and the production cost of parts can be reduced, and thus the writing tool has high marketability, and appeals to consumers.

Furthermore, the slide type writing tool having the dryness prevention unit according to the present invention is advantageous in that the interior of a shaft that holds the nib is air-tightly sealed by a spherical door and a holder, thus increasing the lifespan of the ink, therefore maximizing the performance of the product.

Moreover, the slide type writing tool having the dryness prevention unit according to the present invention is advantageous in that a user holds the shaft corresponding to a body with one hand and manipulates a switch with his or her fingers to extend or retract the nib, therefore being very convenient to use.

Although the preferred embodiment of the present invention is disclosed herein for illustrative purposes, those skilled in the art will appreciate that various modifications, additions and substitutions are possible, without departing from the scope and spirit of the invention as disclosed in the accompanying claims.

BEST MODE

Hereinafter, a slide type writing tool having a dryness prevention unit, according to the preferred embodiment of the present invention, will be described in detail with reference to the accompanying drawings.

Figure 1:
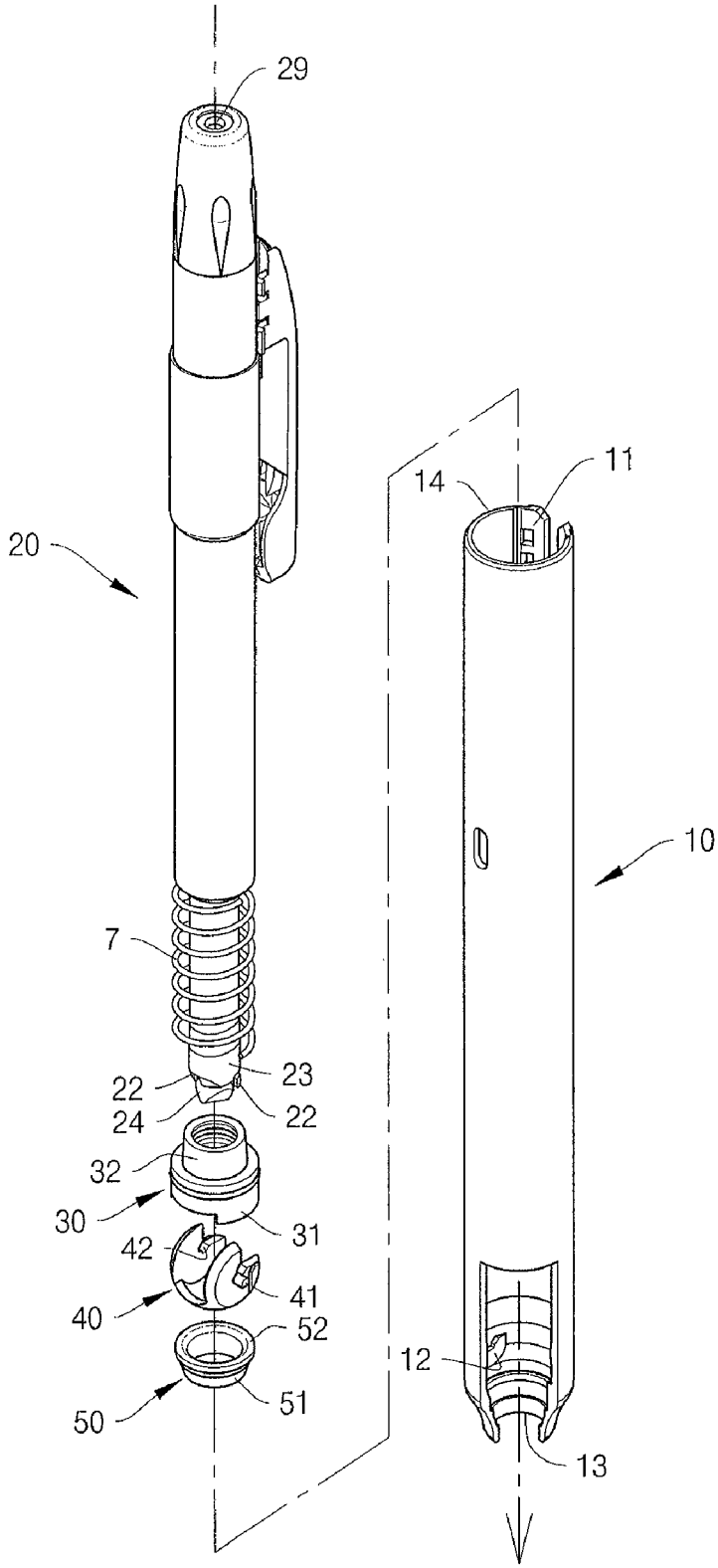
FIG. 1 is an exploded perspective view illustrating the external appearance of a slide type writing tool having a dryness prevention unit, according to an embodiment of the present invention.
Figure 2:
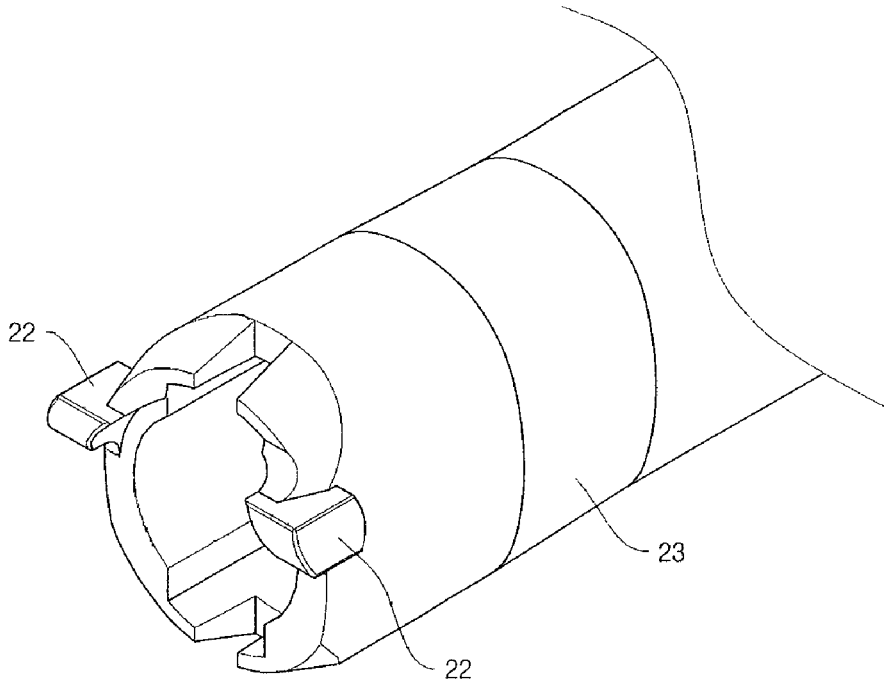
FIG. 2 is a perspective view showing the slide type writing tool having the dryness prevention unit, according to the present invention.

FIG. 1 is an exploded perspective view illustrating the external appearance of a slide type writing tool having a dryness prevention unit, according to an embodiment of the present invention, and FIG. 2 is a perspective view showing the slide type writing tool having the dryness prevention unit, according to the present invention.

Figure 3:
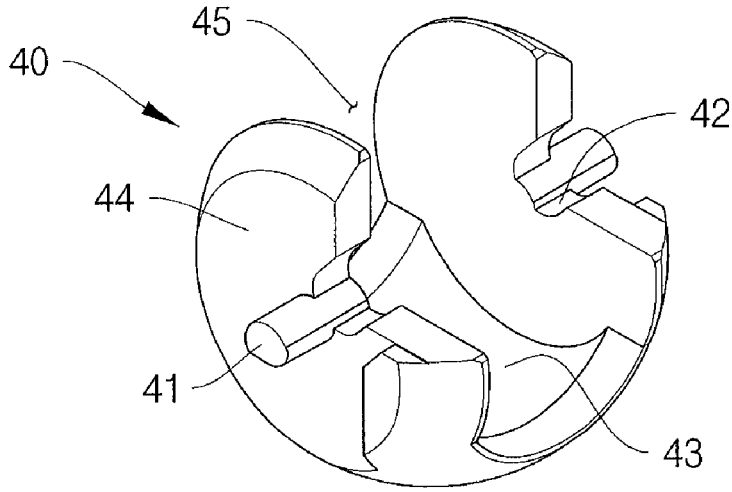
FIG. 3 is a perspective view showing a spherical shutter.
Figure 4:
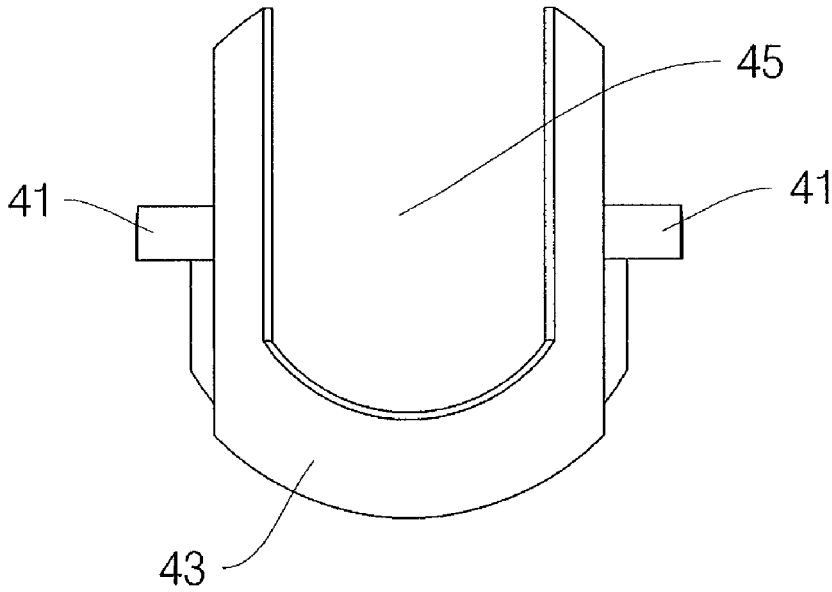
FIG. 4 is a front view showing the spherical shutter of FIG. 3.
Figure 5:
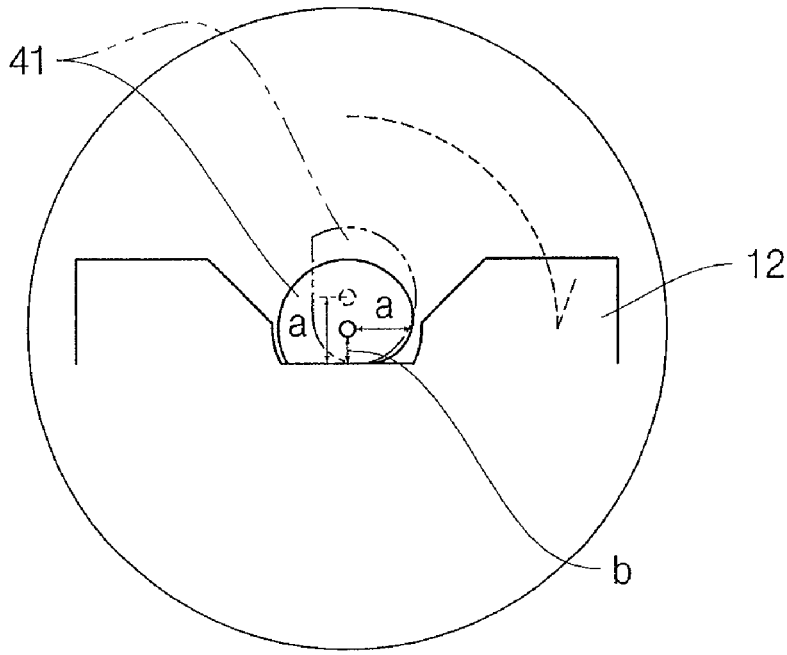
FIG. 5 is a partial enlarged view showing a protrusion of the spherical shutter of FIG. 3.
Figure 6:
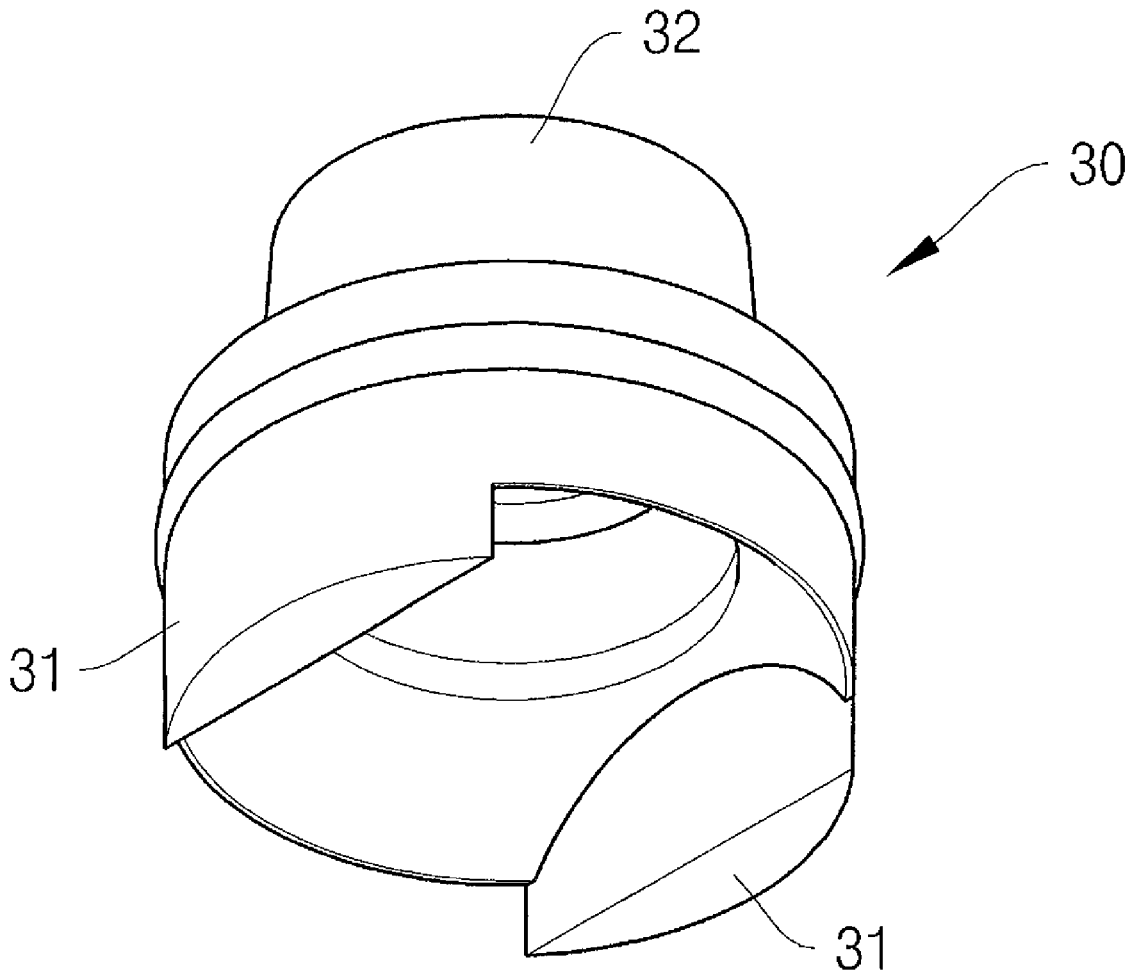
FIG. 6 is a perspective view showing a rear O-ring.

Further, FIG. 3 is a perspective view showing a spherical shutter, and FIG. 4 is a front view showing the spherical shutter of FIG. 3, Further, FIG. 5 is a partial enlarged view showing a protrusion of the spherical shutter of FIG. 3, and FIG. 6 is a perspective view showing a rear O-ring.

Figure 7:
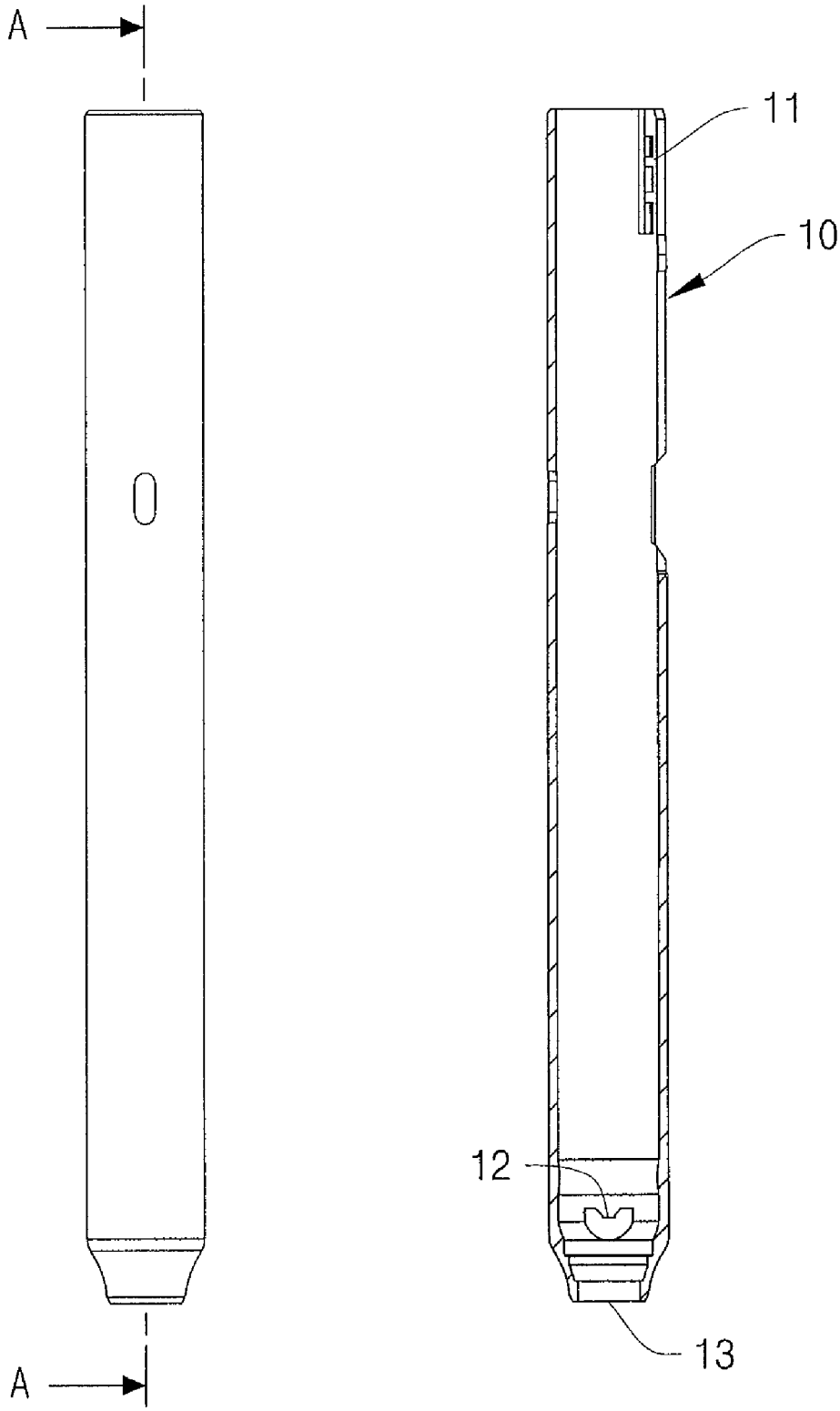
FIG. 7 is a front sectional view showing a shaft of the writing tool.
Figure 8:
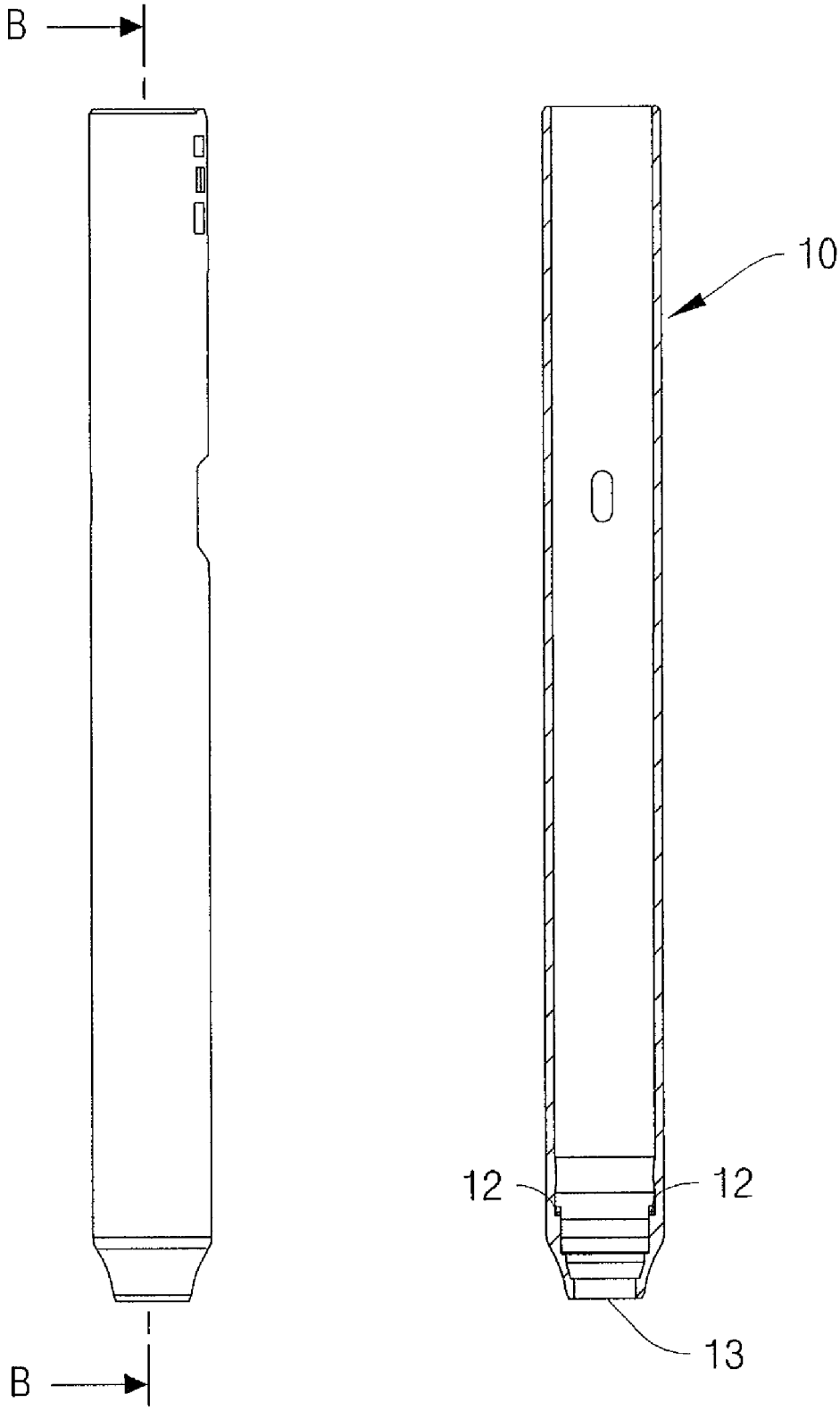
FIG. 8 is a side sectional view showing the shaft of the writing tool.

Further, FIG. 7 is a front sectional view showing a shaft of the writing tool, and FIG. 8 is a side sectional view showing the shaft of the writing tool.

Figure 9:
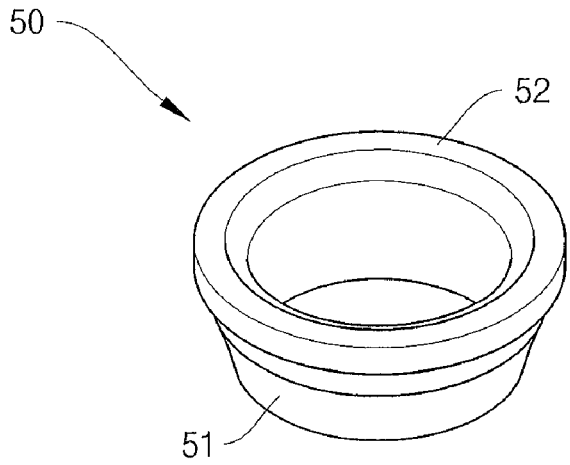
FIG. 9 is a perspective view showing a front O-ring.
Figure 10:
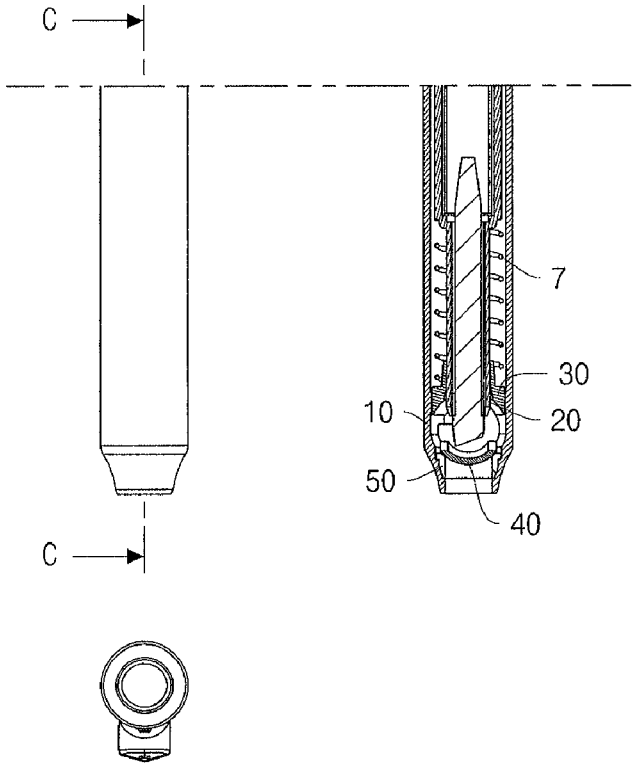
FIG. 10 is a front sectional view showing the assembled state of the slide type writing tool having the dryness prevention unit, according to the present invention.
Figure 11:
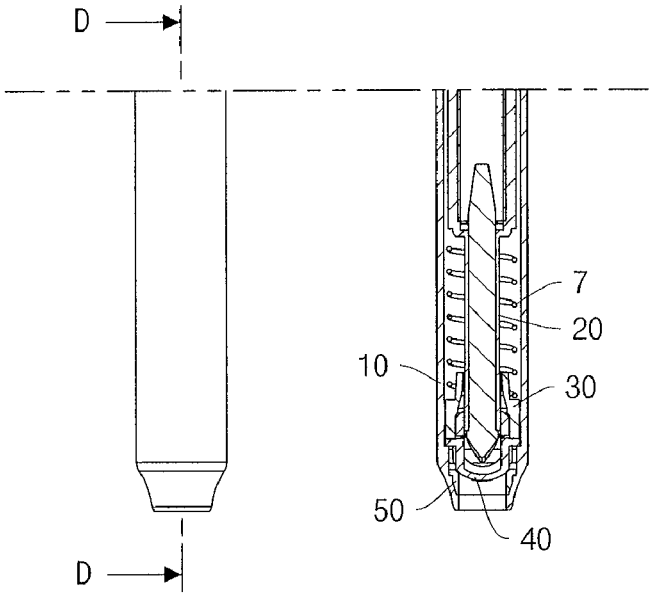
FIG. 11 is a side sectional view of FIG. 10.

FIG. 9 is a perspective view showing a front O-ring, FIG. 10 is a front sectional view showing the assembled state of the slide type writing tool having the dryness prevention unit, according to the present invention, and FIG. 11 is a side sectional view of FIG. 10.

Further, FIGS. 12 to 20 are sectional views showing the operation of the slide type writing tool having the dryness prevention unit, according to the present invention.

The writing tool of the present invention includes a shaft 10, which provides a single body or a body divided into two parts. The dryness prevention unit, which will be described below in detail and is rapidly opened or closed in a direct transmission manner, is installed in the shaft 10.

According to the present invention, the direct transmission manner means that a nib hole 13 of the shaft 10 is air-tightly sealed by a spherical shutter of the dryness prevention unit, but, when a user pushes a knock part 29, the pushing force is directly transmitted to the spherical shutter, so that the spherical shutter is operated.

The nib hole 13 is formed in one end of the shaft 10, which has a conical shape, while the knock part 29 is coupled to the other end of the shaft 10.

That is, the user holds the shaft 10 of the writing tool in one hand, and then presses the knock part 29, which is provided at the upper end of the writing tool and corresponds to a pushing part, with his or her thumb. At this time, the spherical shutter, which is operated in conjunction with the knock part 29 and a cartridge, rotates at a rotating angle of +90° in an opening direction, so that a passage is axially aligned with a nib 24, and simultaneously, the nib hole 13 of the shaft 10 is opened.

Afterwards, the nib 24 projects out from the nib hole 13 through the passage of the spherical shutter, so that the user can write with the writing tool.

Conversely, when the user presses the knock part 29, the projected nib 24 is returned to its original position, that is, is retracted into the shaft 10 by a spring which is provided in the shaft. At this time, the spherical shutter is rotated at a rotating angle of 90° in a closing direction, so that the passage is perpendicular to the nib 24, and simultaneously, the nib hole 13 of the shaft 10 is closed.

Referring to FIG. 1, the slide type writing tool having the dryness prevention unit according to the present invention mainly includes five parts, that is, the shaft 10, the cartridge 20, a rear O-ring 30, the spherical shutter 40, and a front O-ring 50. The writing tool of this invention requires a smaller number of parts than a conventional writing tool, which requires ten or more parts, and is thus easy to assemble.

In the present invention, the shaft 10 may be manufactured through an injection molding process or a molding process using one of rubber, silicone, and soft plastics, thus providing a single body or a body which is divided into two parts.

Further, the shaft 10 has the general characteristics of plastics, namely, elasticity and flexibility.

The nib hole 13 is formed in one end of the shaft 10 and has a size which is sufficient to accommodate the nib 24 of the cartridge 20, while an insert hole 14 is formed in the other end of the shaft 10 and has a size which is sufficient to accommodate the body of the cartridge 20.

Further, an extension control part 11, which is designed to have various forms, is integrated with or is mechanically coupled to the outer circumference of the other end of the shaft 10. Preferably, the extension control part 11 is coupled to a locking part, so that the nib 24 maintains an extended or retracted state.

Further, the nib hole 13 is formed in one end of the shaft 10, which has a conical shape, while the insert hole 14 is formed in the other end of the shaft 10 and has an inner diameter sufficient to accommodate parts that will be described below, including the knock part 29. When showing the external appearance of the writing tool, the knock part 29 is inserted into the insert hole 14.

Referring to FIG. 1, the knock part 29 serves to transmit a User's pushing force to the cartridge 20. Such a knock part 29 has the shape of a tube which has a smaller circumferential part and a larger circumferential part. One end of the knock part, corresponding to the smaller circumferential part, is open, while the other end of the knock part, corresponding to the larger circumferential part, is closed.

Further, according to the present invention, the cartridge 20 has a large-capacity tank, which is capable of continuously and evenly discharging ink through the nib 24 for a predetermined period of time depending on the capacity of the ink tank.

Here, the nib 24 is provided on one end of the cartridge 20. This nib 24 is secured to a hole which is formed in one end of a nib extension shaft 23, so that ink is supplied to the nib.

The nib extension shaft 23 has the shape of a hollow circular tube, supplies ink to the nib, and has a diameter smaller than that of the tank.

Further, the nib 24 is secured to an end of the nib extension shaft 23, and the contents stored in the tank, that is, ink, are fed from the tank to the nib 24 through a conventional ink feeding method, adopted according to the kind of writing tool, for example, a feeding method using a capillary action, a feeding method using a pressure difference, a feeding method using suction, etc.

For the nib 24, a tip for oil- or water-based ink, a correction fluid discharge tip, a tip for highlighters, a tip for marker pens, or another kind of tip is used according to the kind of writing tool. It is possible to use an ink feeding method appropriate to the kind of tip.

The cartridge 20 is operated in conjunction with the extension control part 11. A general extension mechanism, used in a conventional writing tool having a cartridge, may be provided on the locking part.

Further, the cartridge 20 is operated in conjunction with the extension control part 11. An extension mechanism which is similar or equal to a safe knock type mechanism, disclosed in Korean Patent Appln. Nos. 10-2003-55414 and 10-2003-56940, which relate to a safe knock-type writing tool having a low noise cartridge extension mechanism and were filed with the KIPO by the applicant of this invention, may be provided on the locking part.

When the cartridge 20 is inserted into the cartridge insert hole 14 of the shaft 10, and a user then manipulates the extension control part 11, the nib 24 can reciprocate within a predetermined stroke range such that the nib 24 is extended out from or retracted into the nib hole 13 of the shaft 10 by the above extension mechanism, and can temporarily stop at both ends of the stroke.

As shown in FIG. 2, pressing parts 22 are provided on one end of the nib extension shaft 23, which receives the nib of the cartridge therein, in such a way that the pressing parts are symmetrical with respect to each other.

Each pressing part 22 is formed to protrude upwards from the end of the nib extension shaft 23.

One end of the spring 7 contacts the lower end of a step of the cartridge 20.

The spring 7 is operated to axially bias either the rear O-ring 30 or the cartridge 20 within the stroke distance of the cartridge 20.

For example, when the cartridge 20 and the knock part 29 move forwards by a predetermined stroke distance, the spring 7 is compressed. Thereby, the spring 7 generates elastic restoring force, such that the compressed state is restored to an extended state.

According to the present invention, the stroke distance of the cartridge 20 is equal to the stroke distance of the knock part 29.

The rear O-ring 30 and the front O-ring 50 are formed by a hydraulic press using a rubber-type elastic material. Thus, even if the rear O-ring and the front O-ring are repeatedly bent, they are resistant to fatigue, so that durability is good. Further, the rear O-ring 30, the spherical shutter 40, and the front O-ring 50 can be in closer surface contact with each other, thus very effectively preventing ink from drying up.

The rubber-type elastic material is thermosetting butyl rubber. Each part is preferably manufactured using a method suitable for the material.

Further, in order to minimize rubber friction between the rear O-ring 30 and the spherical shutter 40 or between the spherical shutter 40 and the front O-ring 50 when the corresponding parts are coupled to or separated from each other, a lubricant is applied to the parts. The lubricant uses silicone oil, having a viscosity of 100,000 or higher.

As shown in FIG. 6, the rear O-ring 30 has a sealing part 32 and a spherical-shutter support part 31.

The sealing part 32 is a cylinder which has a diameter corresponding to that of the nib extension shaft 23, so that the sealing part air-tightly surrounds the outer circumference of the nib extension shaft 23 of the cartridge 20.

Further, the spherical-shutter support part 31 extends from one end of the sealing part 32, and has a larger diameter than the sealing part 32, to thus accommodate the spherical shutter 40 therein.

The spherical-shutter support part 31 has wings, each having the shape of a half moon. The wings are provided on both sides of one end of the spherical-shutter support part 31 in such a way as to protrude downwards. Thus, the spherical-shutter support part serves to support the spherical shutter 40 such that the spherical shutter rotates around protrusions without being dislodged from a predetermined position.

As shown in FIGS. 3~5, the spherical shutter 40 includes shutter shafts 41, locking steps 42, a shutter part 43, side surfaces 44, and a holding part 45.

The shutter part 43 serves as a door for opening or closing the nib hole 13. The spherical shutter 40 has a hollow spherical shape. A passage, which passes through both sides of the spherical shutter, is axially defined in the spherical shutter, thus serving as a path along which the cartridge is extended or retracted when the writing tool is operated.

The shape of the spherical shutter 40 is defined by the rounded shutter part 43, which is provided on the lower portion of the spherical shutter, and a pair of side surfaces 44, which are perpendicularly coupled to both ends of the shutter part 43 and are parallel to each other.

The shutter part 43 is in close contact with the front O-ring 50, which will be described below in detail, and seals the nib in conjunction with the rear O-ring 30 so as to prevent the ink of the nib from being volatilized.

Each side surface 44 is a fan-shaped flat plate having an arc of about 270°, with the locking step 42 formed in the center of the side surface.

The locking step 42 is shaped to be concave, and is directly subjected to the pressure of the corresponding pressing part 22 of the cartridge 20.

Further, the shutter shafts 41 are protrusions which extend from the corresponding locking steps 42 out of the side surfaces 44 in such a way as to be perpendicular to the side surfaces.

As shown in FIG. 3, each shutter shaft 41 is seated on a corresponding shutter shaft seat 12 of the shaft 10, which will be described below in detail, so that the shutter shaft moves along the shutter shaft seat 12.

Each shutter shaft 41 is a rounded bar, and has a cam shape. Thus, when each shutter shaft 41 rotates, as shown by the dotted lines, the center of the shutter shaft moves upwards. This is upward movement of the spherical shutter 40.

That is, each shutter shaft 41 has a half-moon-shaped section, which has a major axis a and a minor axis b. When the shutter shaft rotates, the center of the shutter shaft moves upwards by a length which is obtained by subtracting b from a.

Thus, the spherical shutter moves upwards by about 0.3 mm, thus being disconnected from the front O-ring 50.

Referring to FIGS. 7 and 8, the shutter shaft seats 12 are provided on the inner wall of the shaft 10.

As shown in FIG. 7, the shutter shaft seats 12 are provided at positions corresponding to the spherical shutter 40, which is held in the shaft, and are protruded to support the corresponding shutter shafts 41.

The lower surface of each shutter shaft seat 12 is a plane. Both sides of the shutter shaft seat are inclined upwards from the lower surface in such a way that the upper portion of the shutter shaft seat is wide and the lower portion of the shutter shaft seat is narrow.

Thus, as each shutter shaft 41 rotates while contacting the lower portion and inclined portion of the shutter shaft seat 12, and moves upwards along the inclined portion, the spherical shutter 40 is pushed up.

As shown in FIG. 9, the front O-ring 50 has a sealing part 52 and a head part 51.

The sealing part 52 is the part which is in close contact with the shutter part 43 of the spherical shutter 40. Further, the sealing part is inserted into the shaft 10 in such a way as to be in close contact with the inner wall of the shaft 10.

The head part 51 is inserted into the shaft 10 in such a way as to be in close contact with the inner wall and end of the nib hole 13 of the shaft 10.

As shown in the front sectional view and the side sectional view of FIGS. 10 and 11, the front O-ring 50 is secured to the shaft 10 in such a way that the outer surface of the front O-ring is in close contact with the inner wall of the shaft. Particularly, the sealing part 52 is in close contact with the shutter part 43 of the spherical shutter 40.

Since the shutter shafts 41 of the spherical shutter 40 are seated on the shutter shaft seats 12 of the shaft 10, the shutter shafts are rotated within the range of the shutter shaft seats 12.

The spherical-shutter support part 31 of the rear O-ring 30 holds the spherical shutter 40, and especially surrounds the side surfaces 44 of the spherical shutter, thus preventing the undesirable removal of the spherical shutter 40.

Further, the sealing part 32 of the rear O-ring 30 surrounds the nib extension shaft 23 of the cartridge 20.

That is, the nib 24 is held in the holding part 45 of the spherical shutter 40 without coming into contact with external air thanks to the sealing part 32 and the shutter part 43.

Further, both ends of the spring 7 contact the step of the coupling part of the cartridge 20 and the step of the rear O-ring 30, so that the spring biases the rear O-ring 30 and the cartridge 20, which are secured to the shaft 10, by a small restoring force.

FIGS. 12 to 20 show the state where the knock part is operated, so that the spherical shutter 40 closes the nib hole 13, starting from the first stroke position. That is, the passage of the spherical shutter 40 is perpendicular to the axial direction of the cartridge 20.

Further, the terms "forward direction" and "backward direction," which will be used below, mean the direction facing the nib hole 13 and the direction facing the knock part 29, respectively.

Figure 12:
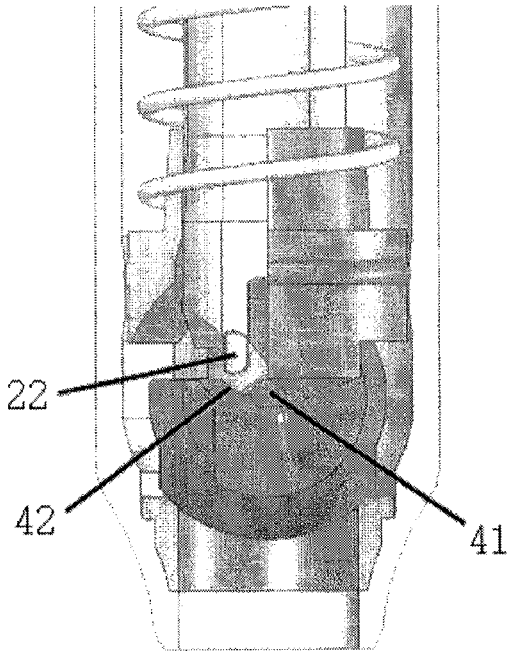
FIGS. 12 to 20 are sectional views showing the operation of the slide type writing tool having the dryness prevention unit, according to the present invention.

In particular, the closed state of FIG. 12 is the state in which the assembly of the parts of FIGS. 10 and 11 has been completed.

As shown in FIG. 12, the nib 24 is surrounded by the spherical shutter 40. The rear O-ring 30 and the cartridge 20 are biased relative to each other by the small restoring force of the spring 7, which contacts both the step of the coupling part of the cartridge 20 and the step of the rear O-ring 30, and surrounds the nib extension shaft 23.

Further, the pressing parts 22 are separated from the locking steps 42.

Figure 13:
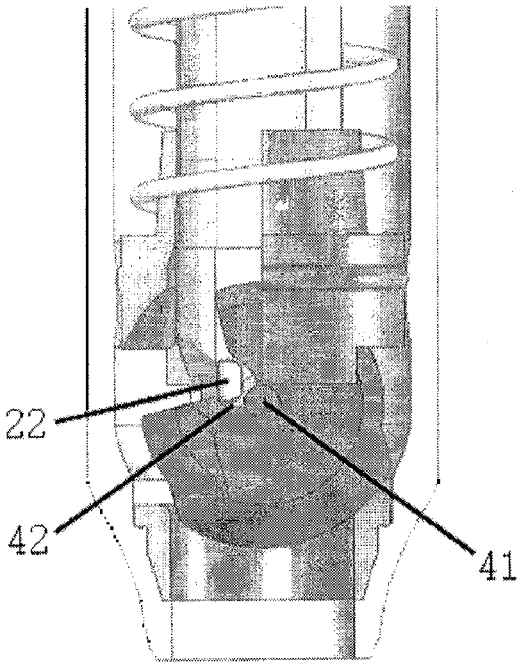

In this state, when force is applied to the knock part, as shown in FIG. 13, the cartridge 20 moves forwards. At this time, the pressing parts 22 press the locking steps 42 of the spherical shutter 40, so that the spherical shutter rotates around the shutter shafts 41.

In this case, the shutter shafts 41 rotate on the corresponding shutter shaft seats 12.

Further, as the spherical shutter 40 rotates, the close contact of the spherical shutter with the sealing part 52 of the front O-ring 50 is released.

Figure 14:
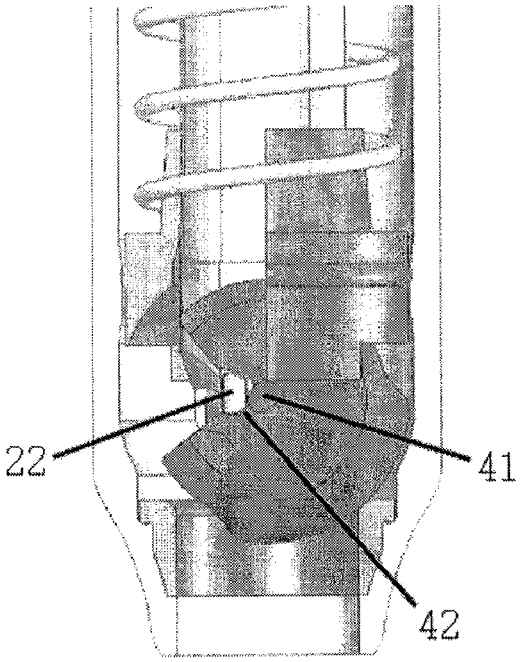

When the knock part is continuously pressed, as shown in FIG. 14, the pressing parts 22 continue to press the locking steps 42. Thereby, the spherical shutter 40 rotates further, so that the sealing part 52 is rotated further from the shutter part 43 and is opened.

Figure 15:
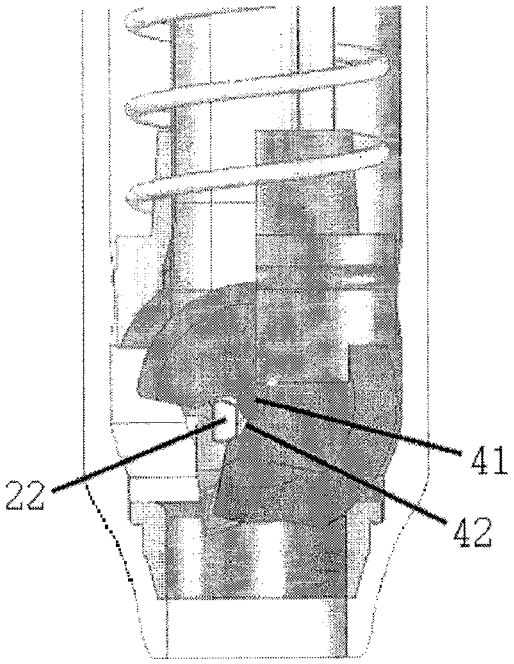

Further, as the pressing parts 22 continue to move forwards, as shown in FIG. 15, the nib 24 is projected through an opening between the sealing part 52 and the shutter part 43.

Further, the entire spherical shutter 40 is moved upwards by the rotation of the shutter shafts 41.

Figure 16:
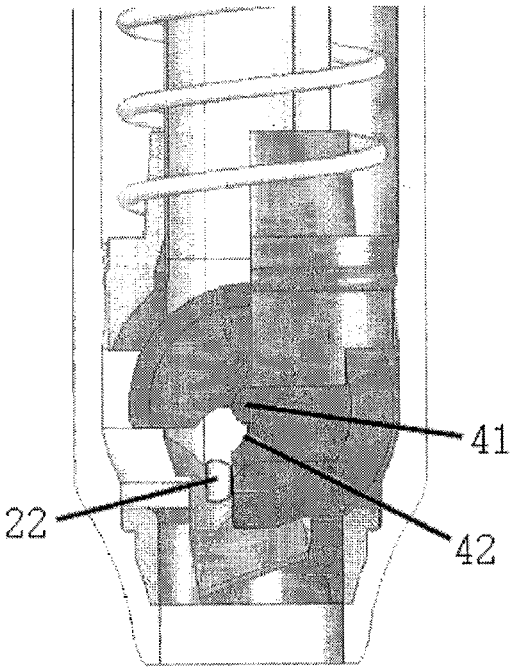

Thereby, as shown in FIG. 16, the nib extension shaft 23, as well as the nib of the cartridge 20, is projected out of the nib hole 13. Until the knock part becomes locked to the shaft 10 and thus does not move forwards anymore, the cartridge 20 passes through the holding part 45 of the spherical shutter 40 and moves forwards, thus being projected out of the nib hole 13. As such, the nib 24, which is projected out of the shaft 10 and is then locked in the projected position, is used.

In order to retract the nib 24 into the shaft 10 and seal the nib in the shaft again, a user presses the knock part so as to release it from the shaft 10.

Figure 17:
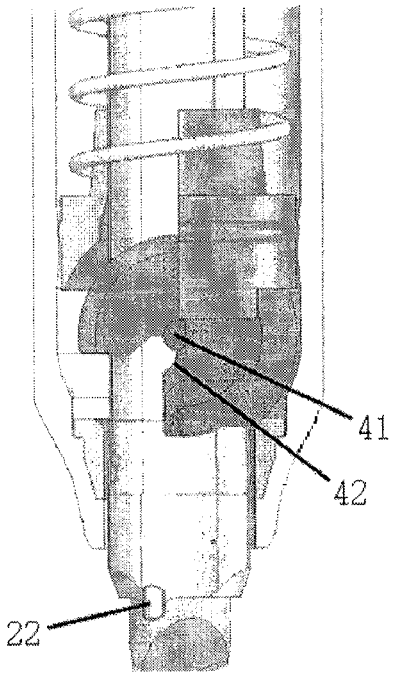

Thus, as shown in FIG. 17, the cartridge 20 moves backwards. At this time, the pressing parts 22 are locked to the locking steps 42 of the spherical shutter 40, thus pushing up the locking steps 42.

As the locking steps 42 are pushed, the spherical shutter 40 rotates around the shutter shafts 41.

Figure 18:
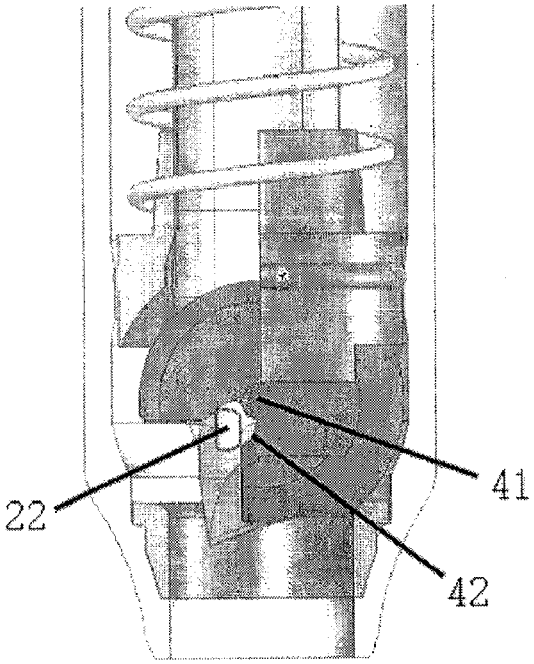
Figure 19:
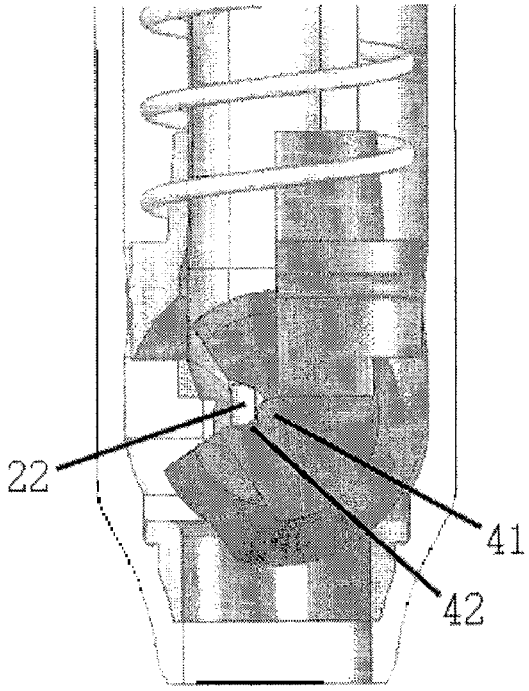

As such, as the pressing parts 22 continue to press the locking steps 42, the spherical shutter 18 is also rotated. Thereby, as shown in FIG. 18, the nib is held in the holding part 45 of the spherical shutter 40, and the shutter part 43 slowly closes the nib hole 13.

Further, the spherical shutter 40 is rotated while it is moved towards the nib hole by the cam-shaped shutter shafts 41.

Figure 20:
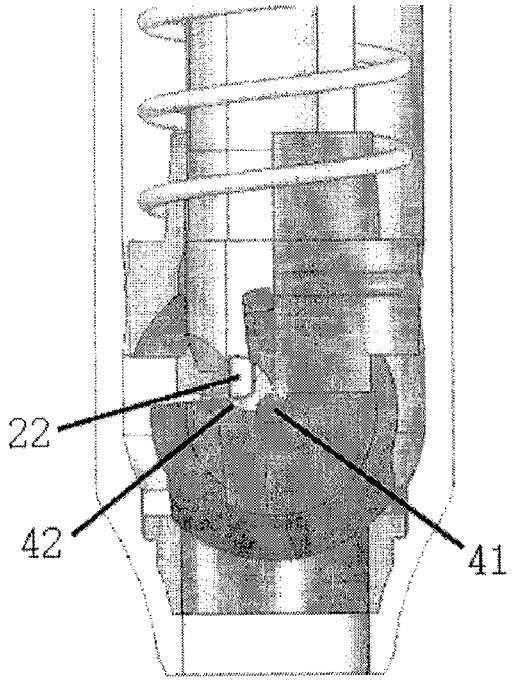

When the cartridge 20 continues moving backwards, so that the pressing parts 22 push up the locking steps 42, as shown in FIG. 20 or 12, the spherical shutter 40 comes into close contact with the front o-ring 50, thus closing the nib hole 13. The nib 24 is held in the holding part 45 of the spherical shutter 40, so that the nib is air-tightly positioned between the rear O-ring 30 and the front O-ring 50, thus minimizing the evaporation of the ink.

The invention claimed is:

1. A writing tool having a dryness prevention unit, comprising:

a hollow shaft (10) having at a first end thereof a nib hole (13), with a shutter shaft seat (12) protruding from an inner wall of the shaft;

a cartridge (20) secured to an interior of the shaft (10) to correspond to a center of the nib hole (13), and comprising a knock part (29) inserted into an insert hole (14) formed in a second end of the shaft (10), and a pair of pressing parts (22) provided on an end of a nib extension shaft (23) of the cartridge;

a rear O-ring (30) surrounding the end of the nib extension shaft (23) of the cartridge (20);

a spherical shutter (40) having a shape of a hollow sphere, held in the rear O-ring (30), and having a spherical shutter part (43) to isolate a nib (24) from an exterior;

wherein the rear O-ring (30) comprises:

a sealing part (32) having a shape of a cylinder which has a diameter corresponding to a diameter of the nib extension shaft (23) such that the sealing part air-tightly surrounds an outer circumference of the nib extension shaft (23) of the cartridge (20); and a spherical-shutter support part (31) having a diameter which is larger than the diameter of the sealing part (32), and supporting the spherical shutter (40), the spherical-shutter support part (31) having a first side and a second side of an end of the spherical-shutter support part;

a front O-ring (50) contacting the shutter part (43), and coming into contact with the nib hole (13); and a spring (7) contacting at a first end thereof a lower end of a step of the cartridge (20), and contacting at a second end thereof a step of the rear O-ring (30), thus axially biasing either the rear O-ring (30) or the cartridge (20) within a stroke distance of the cartridge (20), whereby the spherical shutter (40) is rotated by the pressing parts (22), so that the shutter part (43) opens the front O-ring (50), and thus the nib (24) is projected from the nib hole (13);

wherein the spherical-shutter support part (31) comprises half-moon-shaped wings protruding from both sides of the end of the spherical-shutter support part, thus supporting the spherical shutter (40) so that the spherical shutter rotates around a pair of protrusions without being dislodged from a predetermined position, and causing the nib (24) to be sealed by the spherical shutter (40).

2. The writing tool according to claim 1, wherein each protrusion of the pair of protrusions of the spherical shutter (40) is formed as a cam-shaped shutter shaft (41), so that, when the shutter shaft (41) is rotated, a center of the shutter shaft is moved upwards, and the spherical shutter (40) thus moves upwards.

3. The writing tool according to claim 1, wherein a lower portion of the shutter shaft seat (12) is a plane, and both sides of the shutter shaft seat are inclined upwards from the lower portion in such a way that an upper portion of the shutter shaft seat is wide and the lower portion of the shutter shaft seat is narrow, so that, as the pair of protrusions rotate while contacting the lower portion and inclined sides of the shutter shaft seat (12), the spherical shutter (40) is pushed up.

4. A writing tool having a dryness prevention unit, comprising:

a hollow shaft (10) having at a first end thereof a nib hole (13), with a shutter shaft seat (12) protruding from an inner wall of the shaft;

a cartridge (20) secured to an interior of the shaft (10) to correspond to a center of the nib hole (13), and comprising a knock part (29) inserted into an insert hole (14) formed in a second end of the shaft (10), and a pair of pressing parts (22) provided on an end of a nib extension shaft of the cartridge;

a rear O-ring (30) surrounding the end of the nib extension shaft (23) of the cartridge (20);

a spherical shutter (40) having a shape of a hollow sphere, held in the rear O-ring (30), and having a spherical shutter part (43) to isolate a nib (24) from an exterior;

a front O-ring (50) contacting the shutter part (43), and coming into contact with the nib hole (13); and a spring (7) contacting at a first end thereof a lower end of a step of the cartridge (20), and contacting at a second end thereof a step of the rear O-ring (30), thus axially biasing either the rear O-ring (30) or the cartridge (20) within a stroke distance of the cartridge (20), whereby the spherical shutter (40) is rotated by the pressing parts (22), so that the shutter part (43) opens the front O-ring (50), and thus the nib (24) is projected from the nib hole (13);

wherein the spherical shutter (40) comprises:

the spherical shutter part (43) provided on a lower portion of the spherical shutter, the second spherical shutter part (43) having a first end and a second end;

a pair of side surfaces (44) extending perpendicularly from both ends of the shutter part (43), and arranged to be parallel to each other, thus being in surface contact with a spherical-shutter support part (31), each of the side surfaces being a fan-shaped plate;

a locking step provided on a center of each of the side surfaces, and shaped to be concave, thus being directly subjected to pressure of each of the pressing parts (22) of the cartridge (20); and a shutter shaft (41) comprising a protrusion which perpendicularly extends outwards from the locking step (42) of each of the side surfaces (44), and is seated on the shutter shaft seat (12) of the shaft (10).

* * * * *